US006282402B1

(12) United States Patent
Hayashida

(10) Patent No.: US 6,282,402 B1
(45) Date of Patent: Aug. 28, 2001

(54) IMAGE FORMING APPARATUS AND METHOD FOR SEPARATING AND CONVEYING A TRANSFERRED MATERIAL

(75) Inventor: Masatoshi Hayashida, Kanagawa-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/563,885

(22) Filed: May 3, 2000

(51) Int. Cl.[7] ..... G03G 15/14; G03G 15/16
(52) U.S. Cl. ..... 399/398; 399/315
(58) Field of Search ..... 399/315, 297, 399/310, 397, 398, 92

(56) References Cited

U.S. PATENT DOCUMENTS 4,922,303 * 5/1990 Takeda et al. ..... 399/92
5,132,731 * 7/1992 Oda ..... 399/92
5,410,389 * 4/1995 Poehlein .

FOREIGN PATENT DOCUMENTS 59-40672 * 3/1984 (JP) .
3-138675 * 6/1991 (JP) .
6-67490 * 3/1994 (JP) .
9-222800 8/1997 (JP) .

* cited by examiner

*Primary Examiner*—Susan S. Y. Lee
(74) *Attorney, Agent, or Firm*—Foley & Lardner

(57) ABSTRACT

As a peeling device for peeling off a paper from a photosensitive drum after completing the transfer of an image, a peeling charger and a sucking fan are used jointly and the sucking wind velocity level of the sucking fan can be controlled by switching it with a controller. With the increase in thickness of a paper, the sucking fan is switched and controlled for reducing a wind velocity level of the sucking fan. Further, in the continuous copying, the sucking fan is switched and controlled so as to reduce a sucking wind velocity level until the peeling of the leading edge of a succeeding paper is started after peeling the leading edge of a current paper. Thus, a sucking wind velocity of the sucking fan is minimized when peeling a paper from the photosensitive drum.

3 Claims, 5 Drawing Sheets

IMAGE FORMING APPARATUS AND METHOD FOR SEPARATING AND CONVEYING A TRANSFERRED MATERIAL

BACKGROUND OF THE INVENTION

1. Field of the Invention

The present invention relates to an image forming apparatus for separating a transferred material from an image carrier after completing the transfer of a developer image formed on the image carrier on a transferred material and a method for separating and conveying a transferred material.

2. Description of the Related Art

In an electro-photographic image forming apparatus, a peeling device using a sucking device jointly and acting as a sucking device to suck and peel a paper, that is a transfer material, on which a toner image is transferred electrostatically from the surface of a photosensitive drum by generating an air current in the peeling direction so as to assist an electrostatic peeling device such as a peeling charger for peeling a paper electrostatically by a charging device such as a transfer charger is now attracting attention.

As an example of a sucking device to generate an air current in the peeling direction, a device for assisting the peeling of a paper by an air sucking force by connecting a sucking duct to a separation electric charger has been disclosed in Japanese Patent Disclosure (Kokai) No. 222800/1997.

In the case of this type of peeling device using a sucking device jointly, if the conveying characteristic of a paper is bad after peeled off, the image surface of the paper can be rubbed by a paper conveying rib guide, etc. in a conveying path, the quality of a transferred image can be lowered, the paper conveying rib guide can be stained and furthermore, the jamming of a paper may be caused and therefore, it becomes necessary to provide a sufficient sucking wind velocity by an sucking device in order to assure the stabilized conveyance of a paper after peeled off from a photosensitive drum and prevent the paper from turning back to the photosensitive drum.

However, if the sucking velocity of a sucking device is increased to assure the certain peeling, amount of contaminants sucked such as toner and the like floating around a peeling device by the sucking device will increase. If contaminants are adhered to devices around a peeling device such as the surface of a guide supporter that guides a paper to a transferring device or the surface of a rib guide that guides a paper in the direction of a fixing device after peeling and contaminants are accumulated, the reverse side of a paper being conveyed on the surface of the conveying guide becomes dirty, and the quality of an image transferred on the paper is lowered.

Accordingly, for a peeling device using an electrostatic peeling device and an sucking device jointly, it is demanded to peel off a paper certainly from a photosensitive drum by the sucking force of the sucking device and convey the peeled paper stably and the peeling device is demanded to be capable of reducing amount of contaminants floating around the peeling device and sucked by an sucking device as could as possible and preventing a paper from becoming dirty.

SUMMARY OF THE INVENTION

An object of the present invention is to provide an image forming apparatus capable of minimizing amount of contaminants sucked by a sucking device by reducing the contamination of devices around a peeling device, preventing a paper from becoming dirty and achieving the good quality of copied image even when used for a long period of time in spite of a good peeling property obtained by a sucking device jointly used with an electrostatic peeling device.

Another object of the present invention is to provide a highly reliable image forming apparatus capable of peeling off a paper certainly from a photosensitive drum regardless of kind of paper.

A further object of the present invention is to assure the stable conveyance of a paper peeled off from a photosensitive drum.

An additional object of the present invention is to provide an image forming apparatus capable of peeling paper certainly when peeling and conveying a number of sheets stably and continuously after transferring an image and further, preventing contamination around a peeling device by reducing amount of contaminants sucked by a sucking device and achieving a good quality of copied image even when used for a long period of time.

The present invention provides an image forming apparatus comprising: image forming means for forming a developer image on an image carrier; transfer means for transferring the developer image formed on the image carrier on a transferred material; sucking means capable of switching a sucking wind velocity level for separating the transferred material from the image carrier by an air current after transferring the developer image by the transfer means; and control means for controlling the sucking wind velocity level of the sucking means by varying a control signal to the sucking means.

Further, the present invention provides an image forming apparatus comprising: an image forming portion for forming a developer image on an image carrier; a transferring device for transferring the developer image formed on the image carrier on a transferred material; a sucking device capable of switching a sucking wind velocity level for separating the transferred material from the image carrier after transferring the developer image by the transferring device; and a controller for varying the sucking wind velocity of the sucking device by switching a control signal to the sucking device.

Further, the present invention provides a method for separating and conveying a transferred material in an image forming apparatus, comprising: an exposing step for forming an electrostatic latent image on the surface of an image carrier charged to a specified potential; a developing step for forming a developer image by supplying a developing agent to the electrostatic latent image formed on the surface of the image carrier; a transferring step for transferring the developer image formed on the image carrier onto a transferred material; and a sucking step for separating the transferred material from the image carrier by a sucking means capable of switching a sucking wind velocity level after completing the transferring step.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 2 is a perspective view showing a case and an sucking fan of the image forming portion shown in. FIG. 1;

DETAILED DESCRIPTION OF THE PREFERRED EMBODIMENTS

Preferred embodiments of the present invention will be described below in detail referring to the accompanying drawings.

Figure 1:
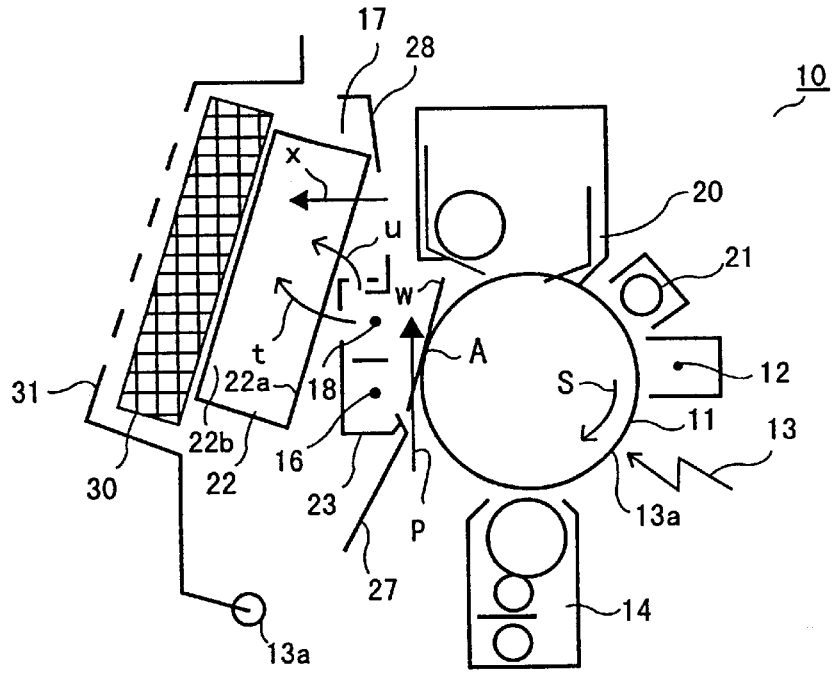
FIG. 1 is a block diagram showing an image forming portion of an image forming apparatus applicable to this embodiment.
Figure 2:
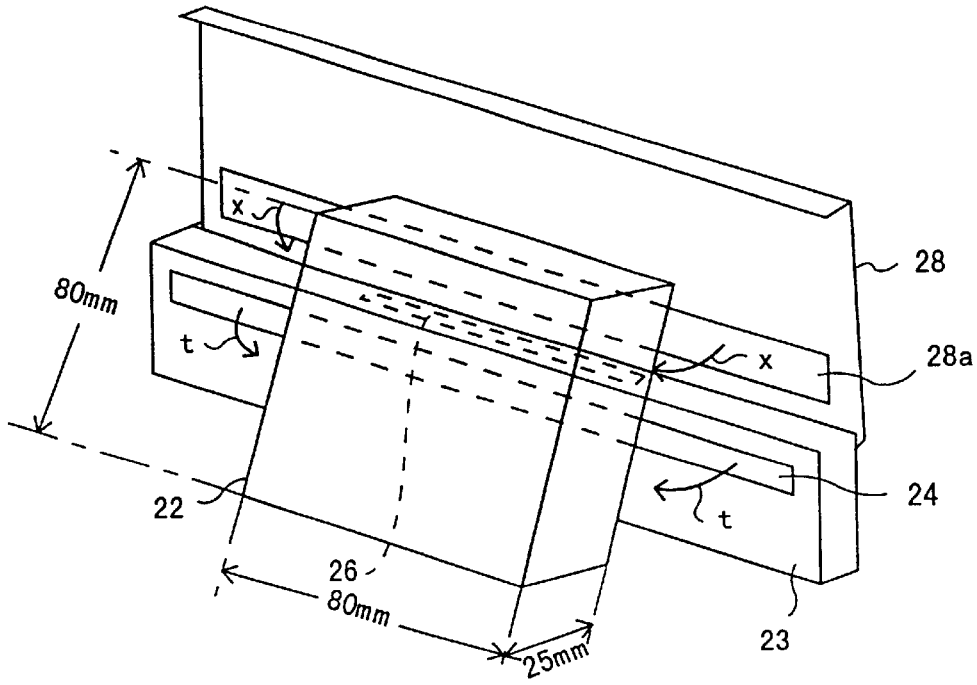

FIG. 1 is a block diagram showing an image forming portion 10 of an electro-photographic image forming apparatus of an embodiment of the present invention such as printer, copying machine and others. This image forming portion 10 adopts a vertical direction paper conveyance to convey a paper P, a transfer material, from the lower part to the upper part of the main body of the image forming apparatus at the transferring position.

A photosensitive drum 11, an image carrier 60ϕ in diameter and 360 mm long negative charge type, is rotated in the direction of arrow s. Around the photosensitive drum 11, along its arrow rotating direction a, there are arranged a main charger 12 to charge the photosensitive drum 11 negative, an exposing unit 13*a* of an exposing device 13, a developing device 14 to develop a toner image with positive charged toner, a transfer charger 16 to charge a paper P negative from its back for transferring a positive toner image formed on the surface of the photosensitive drum 11, a peeling charger 18 comprising a peeling device 17, a cleaning device 20 and a charge eliminating lamp 21.

Further, before and behind the transfer charger 16 and the peeling charger 18, there are provided a guide supporter 27 and a rib guide 28 for conveying a paper P in the vertical direction.

Next, the peeling device 17 will be described in detail. The peeling device 17 comprises the peeling charger 18 that is to peel off a paper P electro-statically from the photosensitive drum 11 by giving AC charge to a paper P absorbed by the photosensitive drum 11 after transferring an image and an sucking fan 22, which is an sucking device to generate an air current to suck the paper P in the direction to peel it from the photosensitive drum 11 at the peeling position. Further, this sucking fan 22 comprises the peeling device 17 and also has an ozone exhausting function of the main body of the image forming apparatus and a temperature rise preventive function in the main body of the image forming apparatus.

On the back of an insulation case 23 at the peeling charger side, enclosing the peeling charger 18 and the transfer charger 16, a first paper sucking window hole 24 is formed for generator the air current in the arrow direction t toward the sucking fan 22 via the peeling charger 18 from the surface of the photosensitive drum 11, extending over the nearly overall length in its longitudinal direction, and on the central area of the surface of the case 23 at the peeling charger 18 side, a second paper sucking window hole 26 is formed for generating an air current in the arrow direction u toward the sucking fan 22 via the peeling charger 18 from the surface of the photosensitive drum 11.

Figure 8:
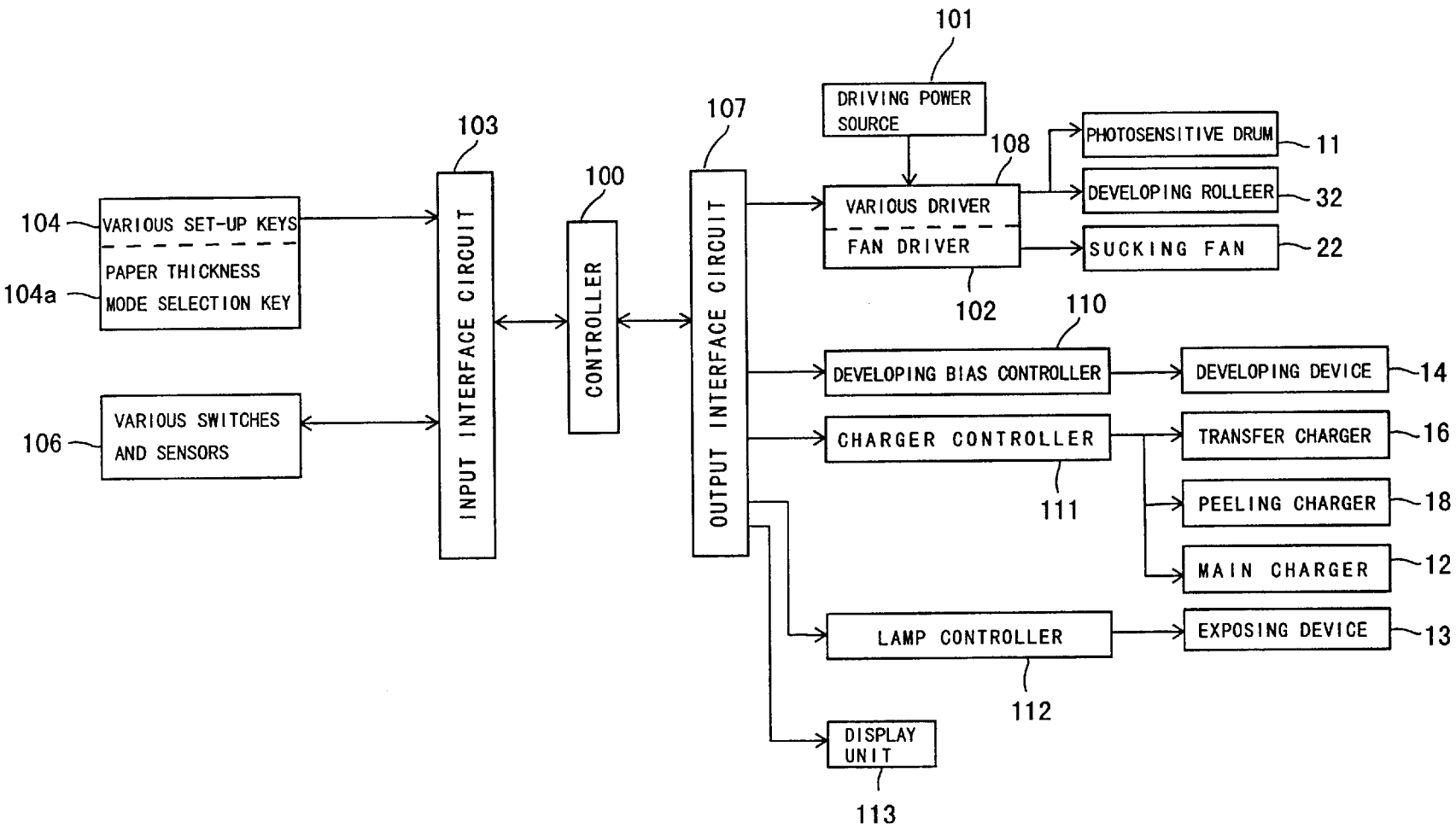
FIG. 8 is a block diagram showing a control system of an image forming apparatus applied to this embodiment.

The sucking fan 22 is a 80×80 $mm^2$ area, 25 mm thick, ϕ70 mm propeller sucking fan equipped with 7 blades provided on the back of the first window hole 24 of the case 23, controlled by a controller 100 of the main body of the image forming apparatus shown in FIG. 8 and can be driven at 3 stages of driving voltages of 14V (Level 1), 24V (Level 2) and 26V (Level 3) according to a thickness of a paper P by applying a fan driver 102 to control voltage of a driving power source 101.

That is, in the case of the thick paper mode for paper weighing more than 90 $g/m^2$ that can be peeled off only by stiffness of a paper P, no absorption is needed for peeling and there is no problem even at 0 m/sec., but in order to exhaust ozone and prevent a temperature rise in the main body of an image forming apparatus, the driving voltage is specified at 14V (Level 1). The driving voltage in the case of the ordinary paper mode for paper weighing less than 90 $g/m^2$ and more than 60 $g/m^2$is specified at 24V (Level 2) and the driving voltage in the case of the thin paper mode for paper weighing less than 60 $g/m^2$ is specified at 26V (Level 3).

The sucking surface 22*a* of the sucking fan 22 is so arranged that it becomes almost parallel with the tangential line w at the paper peeling start point A on the surface of the photosensitive drum 11.

Figure 3:
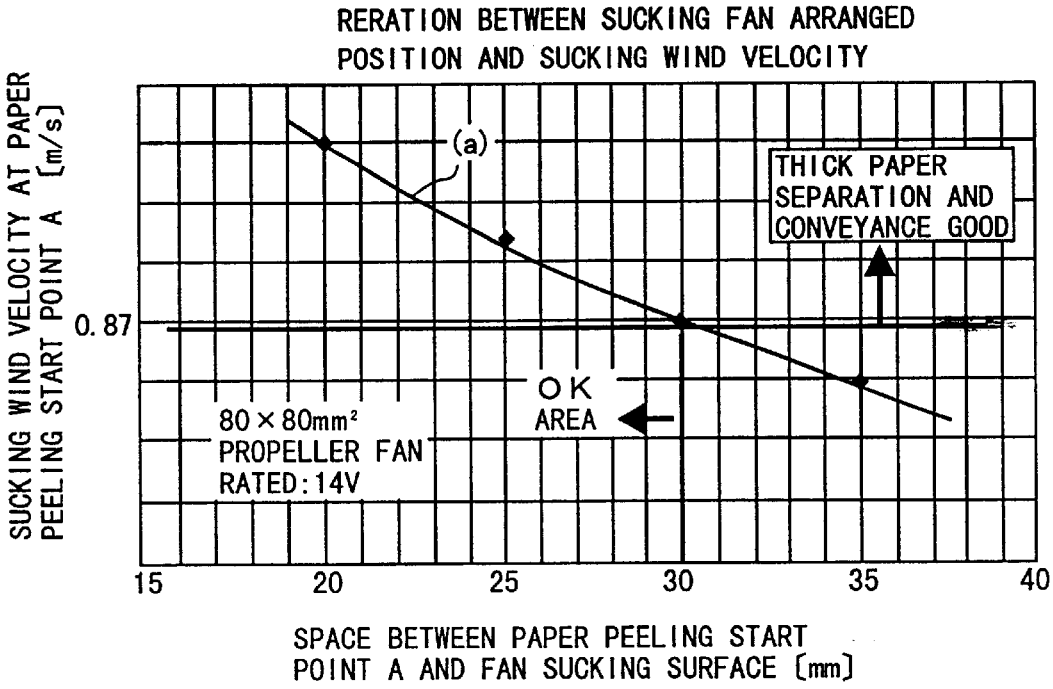
FIG. 3 is a diagram showing the relation between the arranged position of the sucking fan and sucking wind velocity when the sucking fan applied to the embodiment is driven at a rated 14V.
Figure 4:
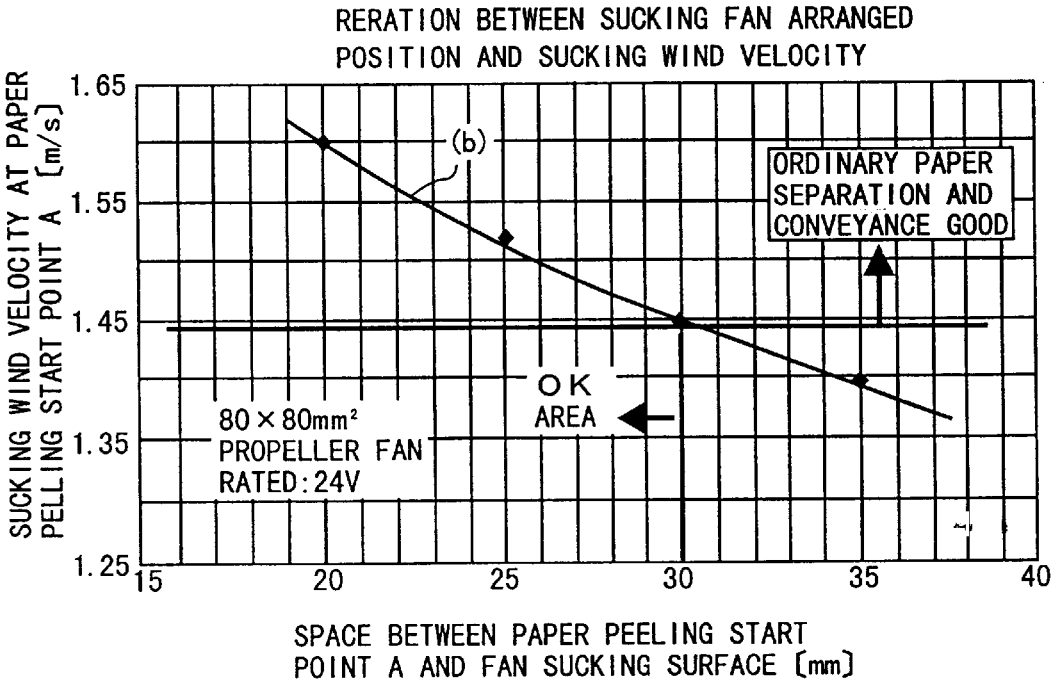
FIG. 4 is a diagram showing the relation between the arranged position of the sucking fan and sucking wind velocity when the sucking fan applied to this embodiment is driven at a rated 24V.
Figure 5:
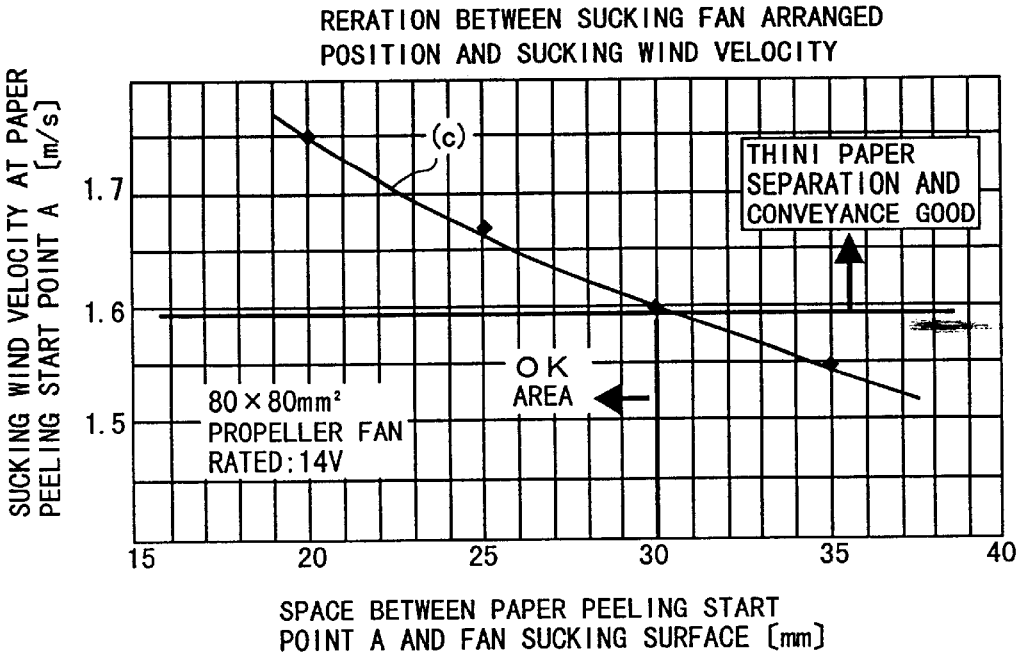
FIG. 5 is a diagram showing the relation between the arranged position of the sucking fan and sucking wind velocity when the sucking fan applied to this embodiment is driven at a rated 26V.

In this embodiment, the sucking wind velocity at the paper peeling start point A on the surface of the photosensitive drum 11 is demanded to be at more than 0 m/sec in the case of the thick paper mode, more than 1.2 m/sec in the case of the ordinary paper mode and more than 1.6 m/sec in the case of the thin paper mode, respectively. Further, in this embodiment the sucking fan 22 has a characteristic to generate sucking wind velocity shown by the solid line (a) in FIG. 3 at the rated voltage 14V, sucking wind velocity shown by the solid line (b) in FIG. 4 at the rated voltage 24V, and sucking wind velocity shown by the solid line (c) in FIG. 5 at the rated voltage 26V. Further, if the sucking surface of the sucking fan 22 is more than 30 mm far from the paper peeling start point A, the leading edge of a paper P cannot be peeled off and therefore, a space between the paper peeling start point A and the central part of the sucking surface 22*a* must be less than 30 mm.

Figure 6:
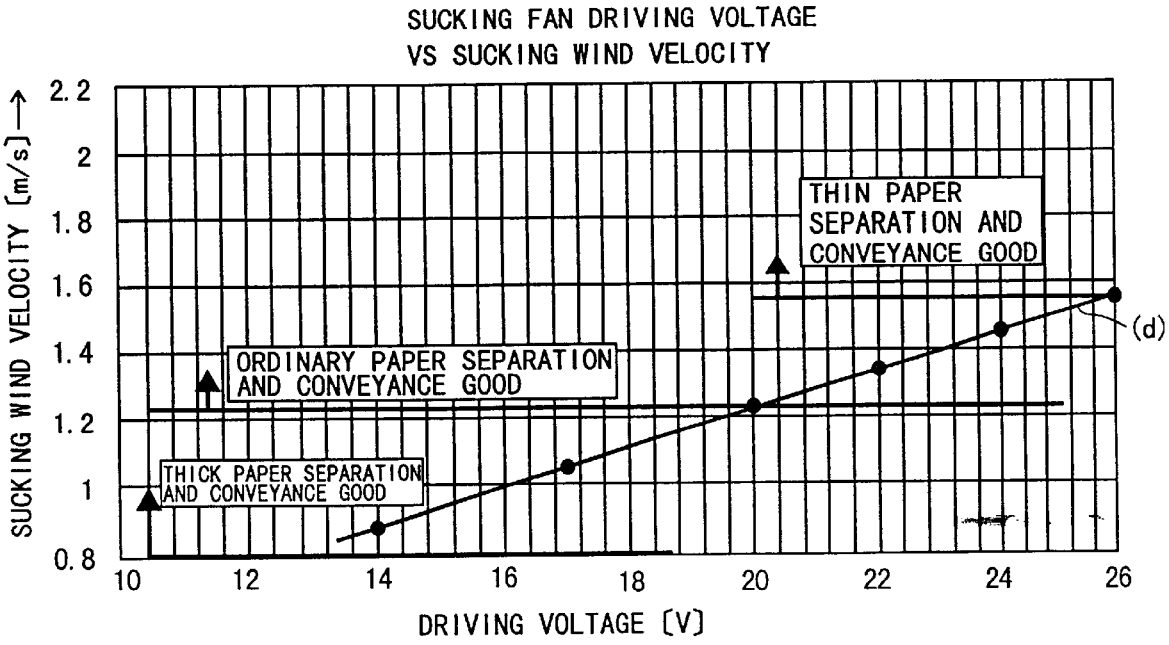
FIG. 6 is a diagram showing driving voltages of an sucking fan applied to this embodiment and sucking wind velocity.

In this embodiment, the paper peeling start point A and the central part of the sucking surface 22*a* are deposited so that a space between them becomes 30 mm, and for the sucking wind velocity at the point 0.87 m/sec. is obtained at the rated voltage 14V, 1.45 m/sec. at the rated voltage 24V and 1.6 m/sec at the rated voltage 26V as shown by the solid line in FIG. 6.

Further, after peeling the leading edge of a proceeding paper regardless of a thickness of a paper P, during the continuous copying, the driving voltage of the sucking fan 22 is reduced until the peeling of a succeeding paper P starts so as to decrease contamination of the guide supporter 27 and the rib guide 28 by the excessive suction by the sucking fan 22.

Figure 7:
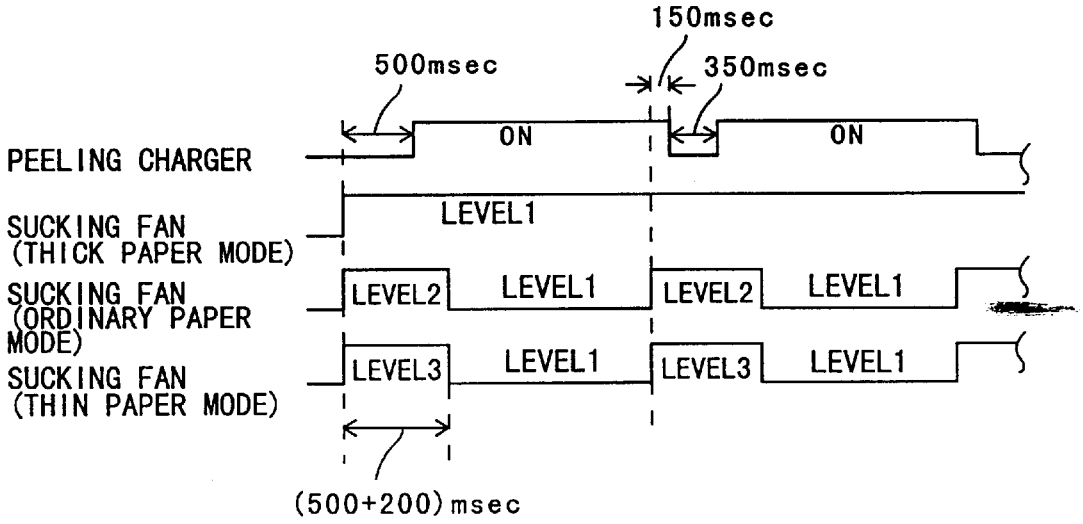
FIG. 7 is a timing chart showing switching timings of the sucking fan driving voltages in a thick paper mode, an ordinary paper mode, and a thin paper mode during the continuous copying of an image forming apparatus applied to this embodiment.

That is, in the thick paper, ordinary paper and thin paper modes, the driving voltage of the sucking fan 22 is set at 14V (Level 1), 24V (Level 2) and 26V (Level 3) and the leading edge of a paper P is peeled and thereafter, the driving voltage is reduced to 14V (Level 1) in the ordinary paper mode and the thin paper mode as shown in FIG. 7. This driving voltage 14V (Level 1) is a driving voltage of the sucking fan 22 required for exhausting ozone and preventing a temperature rise in the main body of an image forming apparatus during the copying even when the peeling operation is not executed.

Further, the driving voltage of the sucking fan 22 during the continuous copying should be switched earlier taking the rotation start timing of the sucking fan 22 into consideration so that the sucking fan 22 reaches the rated speed when the leading edge of a succeeding paper reaches the peeling position after the driving voltage is reduced.

In this embodiment, the minimum required time for the sucking fan 22 to start the rotation is 500 msec. and an interval for paper feed during the continuous copying of A4 size paper is 350 msec. and therefore, the driving voltage of the sucking fan 22 is reduced to Level 1 earlier; actually 200 msec. after peeling the leading edge of an A4 size paper P at the driving voltage of the sucking fan 22 set at one of Level 1~Level 3 according to a thickness of paper P as shown in FIG. 7. (However, the paper conveying speed at this time is 215 mm/sec.)

Hereafter, in the ordinary paper mode or the thin paper mode, the driving voltage of the sucking fan 22 is returned again to one of Level 1-Level 3 according to a thickness of a paper P at 500 msec. before the leading edge of a succeeding paper reaches the peeling position, that is, at 150 msec. before the trailing edge of a preceding paper P reaches the peeling position. Thus, when the leading edge of the succeeding paper reaches the peeling position, the sucking fan 22 reaches a rated speed corresponding to a thickness of each paper and is able to generate a sucking wind velocity sufficient enough for peeling a paper at the peeling position.

The sucking surface 22*a* of the sucking fan 22 that is controlled as described above is extending to the rib guide 28 of the peeled paper conveying path and generates the air current in the arrow direction x via a third window hole 28*a* formed on the rib guide 28, and sucks a paper P to the rib guide 28 when conveying the peeled paper to stably convey a paper P.

At the exhaust surface 22*b* of the sucking fan 22, an ozone decomposition filer 30 in a size almost equal to the external area of the sucking fan 22 is disposed. The transfer charger 16, the peeling charger 18, the sucking fan 22 and the ozone decomposition filer 30 are mounted in one united body to an armor cover 31 that is opened/closed on a shaft 31*a* as a supporting point.

FIG. 8 is a block diagram showing the control system of the main body of the image forming apparatus. Various set-up keys 104 provided on a operation panel (not shown) including a paper thickness selection key 104*a* for switching driving voltages of the sucking fan, and various switches and sensors 106 including a paper sensor switch (not shown) in the paper conveying path, a toner density sensor (not shown), etc. are connected to the input side of a controller 100 through an input interface circuit 103.

Various drivers 108 to control various driving devices such as the photosensitive drum 11, a developing roller 32, etc. by controlling voltage of a driving power source 101, a developing bias controller 110 to control developing bias of the developing device 14 by controlling a bias power source, a charger controller 111 to control voltage applied to the main charger 12, the transfer charger 16, the peeling charger 18, etc. by controlling a high voltage power source, a lamp controller 112 to control quantity of light of an exposing lamp of the exposing device 13, a display unit 113 on the operation panel, etc. are connected to the output side of the controller 100 via an output interface circuit 107.

The various drivers 108 includes a fan driver 102 to control driving voltage of the sucking fan 22.

Next, the operation of the image forming apparatus will be described. When the image forming conditions including the number of sheets, the magnification of copy, paper size, etc. are set when the main body of the image forming apparatus is in the ready state and a kind of paper is an ordinary paper, the key operation on the operation panel (not shown) is not required for starting the copy. In the case of a thick paper weighing more than 90 g/m$^2$ or thin paper weighing less than 60 g/m$^2$, the switching of driving voltage of the sucking fan 22 at the time when the leading edge of paper is peeled off is controlled by operating the paper thickness mode selection key 104*a*.

That is, when the paper thickness mode selection key 104*a* is not operated, the paper mode is judged to be the ordinary paper mode and the driving voltage of Level 2 (24V) or Level 1 (14V) is applied to the sucking fan 22 according to the paper P conveying timing. When the thick paper mode is selected by operating the paper thickness mode selection key 104*a*, the driving voltage of Level 1 (14V) is applied to the sucking fan 22 according to the paper P conveying timing. When the thin paper mode is selected by operating the paper thickness mode selection key 104*a*, the driving voltage of Level 3 (26V) or Level 1 (14V) is applied to the sucking fan 22 according to the paper P conveying timing.

When the copying starts after the image forming conditions are set, a toner image is formed oil the photosensitive drum 11 via the main charger 12, the exposing unit 13 and the developing device 14 in the image forming portion 10 according to the rotation of the photosensitive drum 11 in the arrow direction s.

On the other hand, when a paper P fed from a paper feeding means (not shown) is conveyed in the vertical direction toward the transfer charger 16 in synchronism with a toner image on the photosensitive drum 11, the toner image on the photosensitive drum 11 is transferred on the paper P by the transfer charger 16 and then, the paper P reaches the peeling device 17.

At the peeling device 17, the paper P is peeled off from the photosensitive drum 11 by the AC charged peeling charger 18 and the air current generated from the sucking fan 22.

However, the driving voltage to be applied to the sucking fan 22 is controlled by the fan driver 102 according to a kind of a paper P. That is, when only one sheet is to be copied, the driving voltage of 14V (Level 1) is applied to the sucking fan 22 in the thick paper mode, 24V (Level 2) in the ordinary paper mode and 26V (Level 3) in the thin paper mode, respectively and the sucking wind velocity is generated at the paper peeling start point A according to the driving voltage applied and a paper P is peeled off from the photosensitive drum 11.

Further, in the case of the continuous copying mode, 500 msec. before the leading edge of a paper P reaches the paper peeling start point A, the driving voltage of 14V (Level 1) is applied to the sucking fan 22 in the case of the thick paper mode, 24V (Level 2) in the case of the ordinary paper mode and 26V (Level 3) in the case of the thin paper mode, respectively as shown in FIG. 7 and the leading edge of the paper P reached Point A is peeled off. Then, 200 msec. after the leading edge of the paper P is peeled off, the driving voltage applied to the sucking fan 22 is reduced to Level 1 in the case of the ordinary paper mode or the thin paper mode. Thereafter, 500 msec. before the leading edge of a succeeding paper P reaches the paper peeling start point A, the driving voltage of the sucking fan 22 is returned to either Level 2 or Level 3 according to a kind of a paper P, and the leading edge of a paper P that reached Point A is peeled off.

After peeled, the paper P is landed on the rib guide 28 and conveyed toward the fixing device (not shown) along the rib guide 28, and after an image is fixed, the paper P is ejected. During this period, an air current in the arrow direction x is generated by the sucking fan 22 passing through the third window hole 28*a* on the rib guide 28 and the paper P is stably conveyed on the rib guide 28.

Further, after the photosensitive drum 11 passed the peeling charger 18, residual toner left on there is removed by the cleaning device 20 and the electric charge is eliminated by a charge eliminating lamp 21 and becomes ready for the next image forming.

Figure 9:
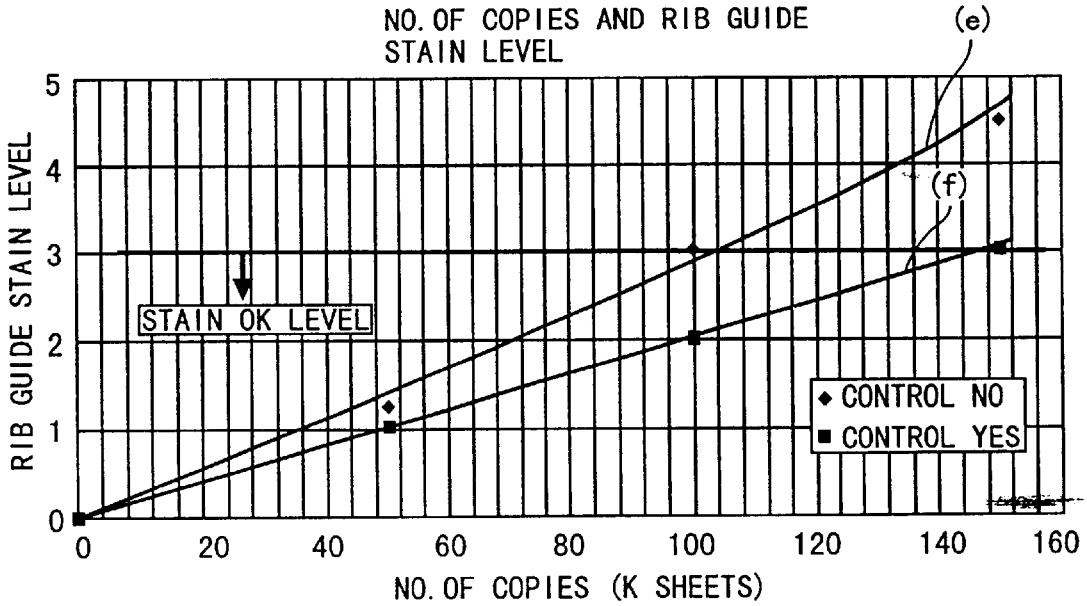
FIG. 9 is a graph showing the relation between the number of coping sheets and the rib guide contamination during the continuous copy of an image forming apparatus applied to this embodiment.

Further, the contamination of the rib guide 28 was measured by executing a continuous paper feeding test using about 150 k sheets of A4 size ordinary paper with the results obtained as shown in FIG. 9. As a result of this test, when a conventional sucking fan which does not control the continuous driving voltage was used, the contamination of the rib guide 28 reached the limit at the continuous copying of about 100 k sheets as shown by the solid line (e) in FIG. 9 and the maintenance was necessitated. On the contrary, in the case of the sucking fan 22 in this embodiment, which controls the driving voltage, contaminants were not off set on paper even when 100 k sheets were copied continuously, a good quality was obtained continuously up to 150 k sheets as shown by the solidline (f) in FIG. 9 and the continuous copying of about 1.5 times of that in the past became possible.

As a paper P is certainly peeled off from the photosensitive drum 11 after an image is transferred, when the peeling charger 18 and the sucking fan 22 are jointly used, the driving voltage of the sucking fan 22 is switched according to a difference of stiffness of a paper P due to thickness, the sucking wind velocity at the paper peeling start point A is changed and thus, even when a thin paper, it can be peeled off certainly without causing a peeling error. Furthermore, after peeled off, a paper P is stably conveyed on the rib guide 28*a* and improved reliability of the image forming apparatus can be obtained.

Further, the sucking wind velocity of the sucking fan 22 when peeling a paper P is controlled to the minimum required level and adhesion of contaminants to the guide supporter 27 and the rib guide 28 around the peeling charger 18 is limited to the minimum as could as possible without impairing its peeling characteristic. Thus, the contamination of a paper P by adhered contaminants is minimized and a good quality without contamination by adhered matters is obtained even when used for a long time.

Further, after the leading edge of a paper is peeled off in the continuous copying, the driving voltage of the sucking fan 22 is reduced and controlled and adhesion of contaminants such as floating toner, etc. to the guide supporter 27 and the rib guide 28 around the peeling charger is reduced as could as possible without impairing the peeling ability of a paper P, the contamination of a paper P by adhered contaminants is minimized, the number of continuous copying sheets can be increased, a good quality is obtained even when used for a long time, and the maintenance property can be further improved.

Further, as the air current to suck a paper P to the rib guide 28 is generated by the sucking fan 22 at the rib guide 28 that is a peeled paper P conveying path, a paper P can be stably conveyed even in the vertical direction.

The present invention is not restricted to the above-mentioned embodiments but can be variously modified within the scope of the prevent invention. For instance, in the above-mentioned embodiments, the driving voltages of the sucking fan in respective paper thickness modes are set at 14V (Level 1), 24V (Level 2) and 26V (Level 3); however, the driving voltages can be set optionally according to specifications of the sucking fan or a designed space between the sucking fan and the photosensitive drum, etc. The number of stages for switching driving voltages of the sucking fan are also not restricted. Set values or the number of switching stages of driving voltages can be changed by a serviceman by selectively setting a code setting menu that is provided in the main body of the image forming apparatus.

Further, the timing for switching sucking fan driving voltages in the continuous copying mode is solely optional provided that the leading edge of a paper can be peeled off certainly, and it is also optional to return a low voltage to a peeling voltage for peeling a succeeding paper according to a time needed to start up the sucking fan. In particular, when the driving voltage reduced after peeling the leading edge of a preceding paper is returned to the original peeling voltage immediately before the leading edge of a succeeding paper reaches by using a sucking fan requiring a short time for starting, an excess sucking between continuously conveyed paper can be eliminated and contaminants adhered to devices near the peeling device can be further reduced.

As described above, according to the present invention, a transfer material can be peeled off certainly from an image carrier regardless of its characteristic by controlling the sucking wind velocity to peel the transferred paper, thus improving reliability of the image forming apparatus and furthermore, adhesion of contaminants such as toner, etc. to devices near the peeling device can be reduced as could as possible, a good quality of copied image is obtained even when used for a long time and in addition, the maintenance of the apparatus can be improved.

Further, in the continuous copying, as the sucking wind velocity required for peeling a paper can be controlled to a low level without impairing the peeling capability of a paper by switching the sucking wind velocity level of the sucking fan, adhesion of such contaminants as toner, etc. to devices around the peeling device can be reduced as could as possible, the number of continuous sheets to be copied can be increased, a good quality of copied image can be obtained even when the apparatus is used for a long time and the maintenance of the apparatus can be improved.

In addition, an air current is generated by the sucking fan to suck a paper to the conveying path side, a paper can be stably conveyed in the conveying path certainly even in the vertical direction after peeled off from the image carrier and thus, the degree of design freedom of the main body of the image forming apparatus is improved.

What is claimed is:

1. An image forming apparatus comprising:

image forming means for forming a developer image on an image carrier;

transfer means for transferring the developer image formed on the image carrier on a transferred material;

sucking means capable of switching a sucking wind velocity level for separating the transferred material from the image carrier by an air current after transferring the developer image by the transfer means, wherein when the image forming means continuously forms the developer image on the image carrier and the transfer means continuously transfers the developer image on plural transferred materials that are continuously conveyed, the sucking means is capable of switching to reduce the sucking wind velocity after peeling off each leading edge of plural transferred materials; and control means for controlling the sucking wind velocity level of the sucking means by varying a control signal to sucking means.

2. An image forming apparatus comprising:

an image forming portion for forming a developer image on an image carrier;

a transfer device for transferring the developer image formed on the image carrier on all transferred material;

a sucking fan capable of switching a sucking wind velocity level for separating the transferred material from the image carrier by an air current after transferring the developer image by the transfer device, wherein when the image forming portion forms the developer image continuously on the image carrier and the transfer device transfers the developer image continuously on plural transferred materials that are continuously conveyed, the sucking fan is capable of switching to reduce the sucking wind velocity after peeling off each leading edge of plural transferred materials; and a controller for varying the sucking wind velocity of the sucking fan by varying a control signal to the sucking fan.

3. A method for separating and conveying a transferred material in an image forming apparatus, comprising:

an exposing step for forming an electrostatic latent image on the surface of an image carrier charged to a specified potential;

a developing step for forming a developer image by supplying a developing agent to the electrostatic latent image formed on the surface of the image carrier;

a transferring step for transferring the developer image formed on the image carrier onto a transferred material; and a sucking step for separating the transferred material from the image carrier by a sucking device capable of switching a sucking wind velocity level after completing the transferring step, wherein said sucking wind velocity level is switched to decrease in the sucking step after separating the leading edge of each of plural transferred materials when the developer image is continuously transferred on plural transfer materials that are continuously conveyed.

* * * * *